US010738516B1

(12) United States Patent
Lawrence

(10) Patent No.: US 10,738,516 B1
(45) Date of Patent: Aug. 11, 2020

(54) WINDOW LOCK WITH ADJUSTABLE REINFORCEMENT MEMBERS

(71) Applicant: Barry G. Lawrence, Thomasville, NC (US)

(72) Inventor: Barry G. Lawrence, Thomasville, NC (US)

( * ) Notice: Subject to any disclaimer, the term of this patent is extended or adjusted under 35 U.S.C. 154(b) by 348 days.

(21) Appl. No.: 15/681,488

(22) Filed: Aug. 21, 2017

(51) Int. Cl.
*E05C 3/04* (2006.01)
*E05C 1/00* (2006.01)
*E05B 65/08* (2006.01)

(52) U.S. Cl.
CPC ..... *E05C 3/046* (2013.01); *E05B 65/08* (2013.01); *E05C 1/002* (2013.01)

(58) Field of Classification Search
CPC ..... E05C 2007/007; E05C 3/046; E05C 1/12; E05C 1/10; E05C 3/045; E05C 1/14; E05C 3/14; E05C 9/025; E05C 1/04; E05C 9/042; E05B 65/0864; E05B 65/0876; E05B 63/0056; E05B 63/06; E05B 15/0053; E05B 15/0205; E05B 17/2088; E05B 2015/1664; E05B 63/00; E05B 9/00; E05B 9/02; Y10T 292/1041; Y10T 292/096; Y10T 70/5146; Y10T 403/7005; Y10S 292/47; Y10S 292/20
See application file for complete search history.

(56) References Cited

U.S. PATENT DOCUMENTS

| | | | | | |
|---|---|---|---|---|---|
| 4,801,164 | A * | 1/1989 | Mosch | E05C 3/046 | 292/204 |
| 5,161,839 | A * | 11/1992 | Piltingsrud | E05C 3/046 | 292/241 |
| 6,142,541 | A * | 11/2000 | Rotondi | E05C 3/046 | 292/241 |
| 6,568,723 | B2 * | 5/2003 | Murphy | E05B 65/0835 | 292/241 |
| 7,017,957 | B2 * | 3/2006 | Murphy | E05B 65/0835 | 292/241 |
| 8,092,114 | B2 * | 1/2012 | Baur | E05B 63/123 | 403/254 |
| 9,260,893 | B1 * | 2/2016 | Ruspil | E05C 1/10 | |
| 9,341,006 | B1 * | 5/2016 | Lawrence | E05C 3/046 | |
| 9,617,765 | B1 * | 4/2017 | Lawrence | E05B 63/20 | |
| 2008/0179896 | A1 * | 7/2008 | Chung | E05B 63/20 | 292/164 |
| 2009/0179436 | A1 * | 7/2009 | Sagalara | E05B 65/0864 | 292/174 |
| 2010/0207403 | A1 * | 8/2010 | Bourgoin | E05B 63/20 | 292/335 |

* cited by examiner

*Primary Examiner* — Mark A Williams
(74) *Attorney, Agent, or Firm* — Tuggle Duggins; Blake P. Hunt

(57) ABSTRACT

A window lock with a lock housing positioned on a first window sash and containing a cam rotatably connected to a handle protruding vertically from the housing and including two adjustable reinforcement members extending laterally from the rear surface of the lock housing is provided. The window lock also includes a lock keeper positioned on a second, adjacent window sash with a central slot sized and shaped to receive the cam therein and a pair of channels oriented in longitudinally opposing orientation relative to the central slot, each channel defining a "T" shape to receive each of the adjustable reinforcement members therein.

15 Claims, 3 Drawing Sheets

WINDOW LOCK WITH ADJUSTABLE REINFORCEMENT MEMBERS

FIELD OF THE INVENTION

The invention herein pertains to window hardware and particularly pertains to a window lock housing with one or more adjustable reinforcement members received within a corresponding reinforced window latch.

DESCRIPTION OF THE PRIOR ART AND OBJECTIVES OF THE INVENTION

Securing entry into a home or office is a difficult challenge given the relatively small size of the hardware designed to accomplish the task. The conventional window lock design includes a handle that extends above a housing that is mechanically linked to a cam, providing a user manual means for locking or unlocking a window as the cam frictionally engages a keeper positioned on an adjacent sash. However, this conventional design suffers from a low impact rating, indicating that the lock can easily become disengaged from the keeper, allowing the window to be forced open, either inadvertently or through malicious intent. Other undesirable access events may occur from natural causes, such as significant wind and driving rain, and these problems are only exacerbated with society's increasing use of composite materials. In order to more securely deploy window locks, significant mechanical features may be utilized. However, these mechanisms are complex, expensive, and may inadvertently obstruct authorized window use. Further, many of these additional security features are formed in a factory, before the precise measurements necessary to install a functional window lock are determined. Although such factors may be considered in a range at the time of manufacturing, such engineering leads to play in the lock function, increasing the concern for inadvertent disengagement as described above.

Thus, in view of the problems and disadvantages associated with prior art devices, the present invention was conceived and one of its objectives is to provide a window lock with an adjustable reinforcement member configured (i.e. sized and shaped) to be received into a corresponding keeper.

It is another objective of the present invention to provide a window lock with a housing including one or more adjustable reinforcement members positioned atop a first window sash, and a keeper with corresponding channels positioned atop a second, adjacent window sash, the channel(s) configured (i.e. sized and shaped) to receive the one or more adjustable reinforcement members therein.

It is still another objective of the present invention to provide a window lock with an adjustable reinforcement member extending laterally from the lock housing to engage a corresponding keeper.

It is yet another objective of the present invention to provide a window lock with a pair of adjustable reinforcement members at opposing sides of the cam contained within the lock housing, each adjustable reinforcement member defined as a threaded screw with a head having a greater diameter than the threaded body.

It is a further objective of the present invention to provide a window lock that exhibits increased security and resistance to inadvertent displacement from the keeper.

It is still a further objective of the present invention to provide a window lock and keeper that are efficient to manufacture and relatively simple to install effectively.

It is yet a further objective of the present invention to provide a lock keeper including a pair of slots positioned at opposing longitudinal ends of the keeper and defining a "T" shape to accommodate the larger diameter head and smaller diameter body of the respective adjustable reinforcement members.

Various other objectives and advantages of the present invention will become apparent to those skilled in the art as a more detailed description is set forth below.

SUMMARY OF THE INVENTION

The aforesaid and other objectives are realized by providing a window lock with a lock housing positioned on a first window sash and containing a cam rotatably connected to a handle protruding vertically from the housing and including two adjustable reinforcement members extending laterally from the rear surface of the lock housing. The window lock also includes a lock keeper positioned on a second adjacent window sash with a central slot sized and shaped to receive the cam therein and a pair of channels oriented in longitudinally opposing orientation relative to the central slot, each channel defining a "T" shape to receive each of the adjustable reinforcement members therein. By capturing the cam and two or more adjustable reinforcement members at multiple points along the length of the keeper, the instant lock creates a far more secure lock which is more resistant to inadvertent disengagement from the keeper than hardware taught by the prior art.

DETAILED DESCRIPTION OF THE PREFERRED EMBODIMENT AND OPERATION OF THE INVENTION

Figure 1:
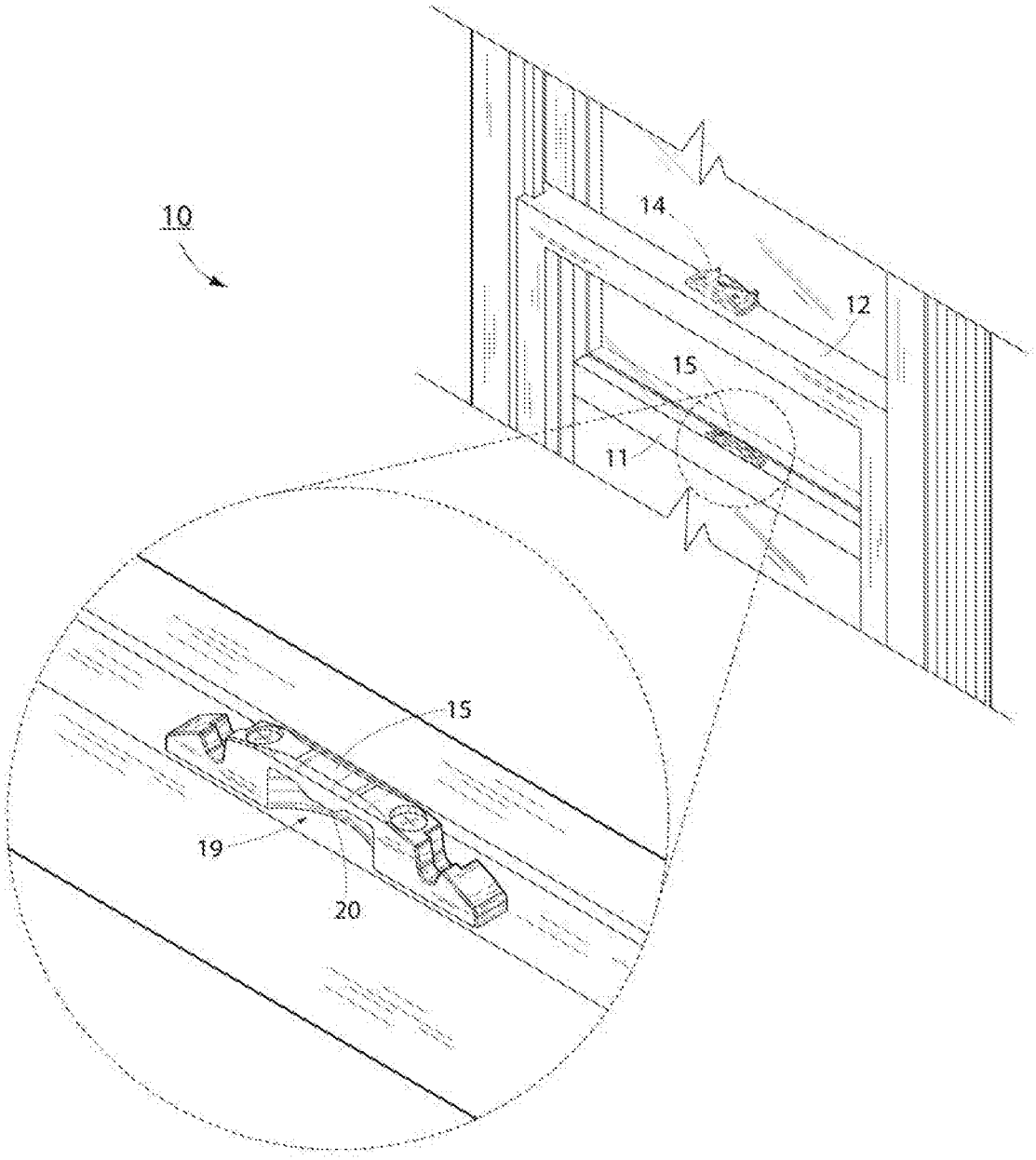
FIG. 1 shows a double-hung window including a window lock with adjustable reinforcement members.
Figure 2:
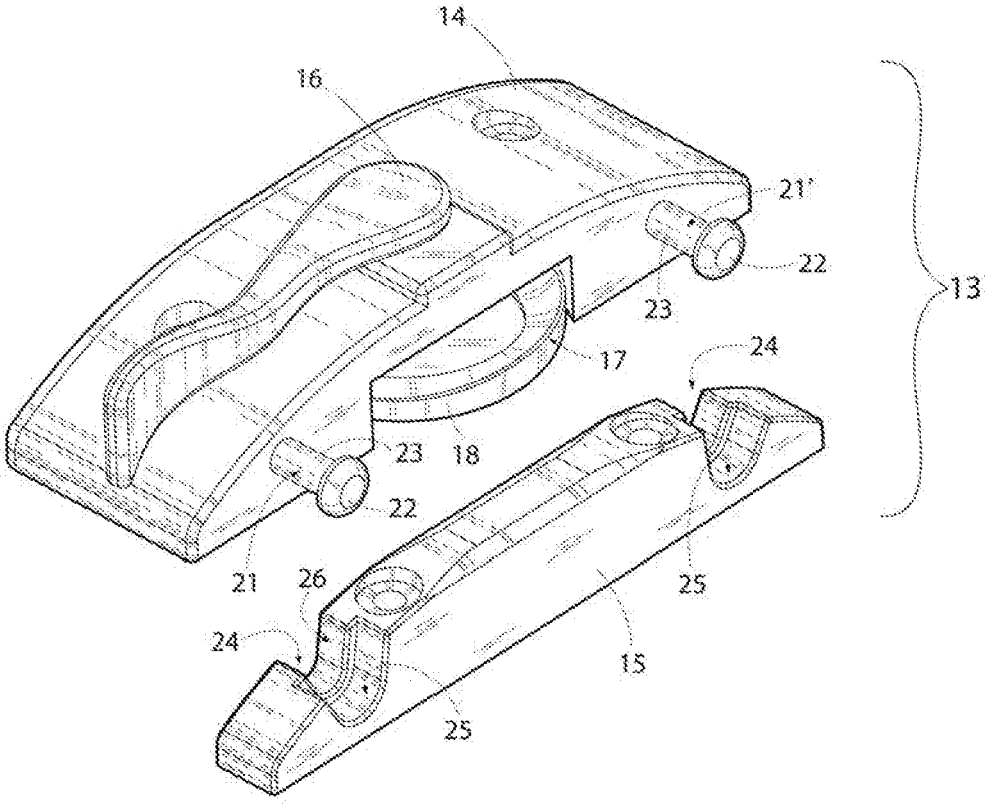
FIG. 2 pictures a perspective view of the window lock with adjustable reinforcement members of FIG. 1 separated from a keeper.
Figure 3:
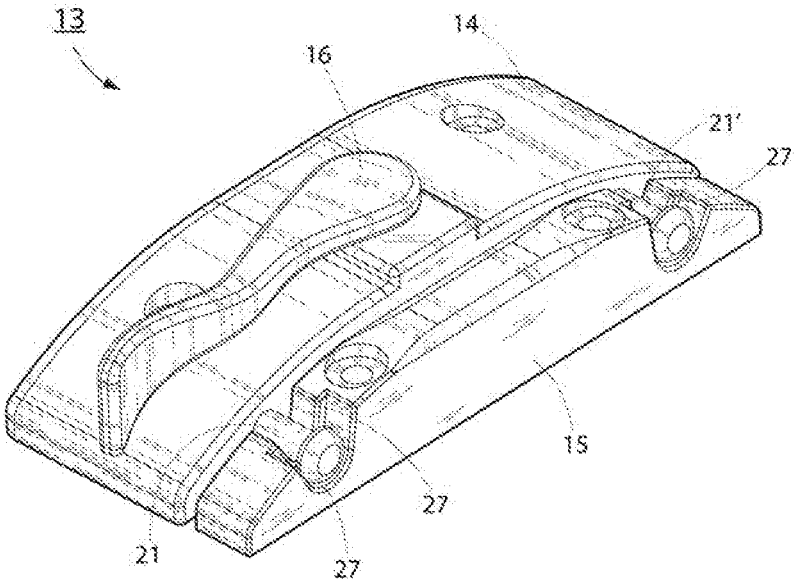
FIG. 3 depicts a perspective view of the window lock with adjustable reinforcement members of FIG. 2 engaged with the keeper.

For a better understanding of the invention and its operation, turning now to the drawings, FIG. 1 is an illustrative representation of a conventional double-hung window 10 that includes upper sash 11 and lower sash 12 positioned therein. Window lock 13 is preferably an assembly including lock housing 14 positioned on lower sash 12 and lock keeper 15 positioned on upper sash 11. As would be understood, handle 16 is rotatably connected to cam member 17 disposed substantially within lock housing 14, such that when handle 16 is manually engaged, tongue 18 extends outwardly relative to lock housing 14 to frictionally engage with lock keeper 15. Tongue 18 includes a gradually sloping outer surface that mates with lock keeper 15 to secure double-hung window 10 in the closed position.

Despite the popularity of utilizing cam 17 to engage with lock keeper 15, this system suffers from undesirable performance when encountering impact stimulus or severe weather that may result in inadvertent disengagement of cam 17 from keeper 15. Specifically, keeper 15 may define a central slot 19 with protrusion 20 that nests within a portion of tongue 18, but as central slot 19 may be sized and shaped to rotatably receive cam member 17 therein, there are limits as to the size and shape of protrusion 20, effectively limiting how much stimuli can be resisted by the engagement of tongue 18 and protrusion 20 before the engagement fails. Therefore, embodiments of window lock 13 include one, and preferably at least two, adjustable reinforcement members (also referred to as members herein) 21, 21' extending laterally away from lock housing 14. Each adjustable reinforcement member 21 is preferably configured (i.e. sized and shaped) to include a head portion 22 and a body portion 23 connecting the head portion 22 to the lock housing 14. In the preferred embodiment, the distance between the lock housing 14 and head portion 22 of the adjustable reinforcement member 21 may vary, for example depending on the distance between lock housing 14 and keeper 15 after installation on respective upper sash 11 and lower sash 12. This adjustability will bestow window lock 13 with advantageous flexibility compared to other window hardware in the prior art. Adjustable reinforcement members 21, 21' may adjustably engage lock housing 14 in a variety of different ways, but the preferred adjustable reinforcement member 21 includes a body portion 23 that defines a plurality of threads (not shown), resulting in an adjustable reinforcement member that is a threaded member, for example comparable to a threaded fastener like a screw. By rotating the adjustable reinforcement member 21 clockwise or counterclockwise, precise adjustments determined by the specific operating environment of window lock 13 can be accounted for, and a greater likelihood for a successful window hardware installation may be achieved. Although reinforcement members 21, 21' may successfully engage a wall of lock housing 14 as described above, it may be desirable to form a receiver (not shown) sized and shaped to adjustably receive at least a portion of body portion 23 therein. For example, a sleeve structure (not shown) may be added or formed integrally with lock housing 14 to provide additional surface area for one or more reinforcement members 21 to contact, creating a more structural sound and durable engagement between lock housing 14 and the one or more adjustable reinforcement members 21.

Window lock 13 also includes an improved lock keeper 15 which aids in the improvement of window lock 13 relative to the prior art. In addition to central slot 19 described above, lock keeper 15 preferably includes one or more channels 24 defined in an exterior surface therein. As would be understood, the number of channels 24 may correspond with the number of adjustable reinforcement members 21, such that each adjustable reinforcement member 21 seats within a separate channel 24. In an embodiment, a pair of channels 24 are positioned in opposing longitudinal relation relative to central slot 19. Each channel 24 is sized and shaped to receive a portion of adjustable reinforcement member 21 therein, and in the preferred embodiment, channel 24 is sized and shaped to receive substantially all of head portion 22 within respective channel 24, as well as a portion of body portion 23. As one of the prime benefits of window lock 13 is preventing the inadvertent disengagement of cam member 17 from lock keeper 15, a preferred embodiment of keeper 15 includes channels 24 that define a substantially "T" shape, in that each channel 24 includes a first portion 25 that is sized and shaped to accommodate the larger diameter of head portion 22 therein and a second portion 26 that is sized and shaped to accommodate the smaller diameter of body portion 23, but that may not accommodate head portion 22. Specifically, the diameter of first portion 25 may approximate the diameter of head portion 22 and the diameter of second portion 26 may approximate the diameter of body portion 23. Shoulders 27 may define the transition between first portion 25 and second portion 26, which prevent head portion 22 from inadvertently disengaging from keeper 15.

Additionally, or in the alternative, two or more conventional threaded fasteners (not shown) may be vertically inserted into lock keeper 15 to prevent distortion of lock keeper 15 and further prevent inadvertent disengagement of cam member 17 from lock keeper 15. It is advantageous to position channels 24 outboard of to facilitate a more structural secure keeper and by utilizing more than one fastener, pivoting about said fastener is effectively eliminated. The apertures for receiving the threaded fasteners may be countersunk to present a more aesthetically pleasing presentation upon installation, but such is not required. An embodiment of lock keeper 15 may further include an additional threaded fastener installed outboard of the channel 24, which indicates that each channel 24 would be flanked both inboard and outboard by threaded fasteners holding lock keeper 15 in place (additionally hole and fasteners not shown), further adding to the structural stability of lock keeper 15 and window lock 13 overall.

Further, the use of one or more adjustable reinforcement members 21 to engage lock keeper 15 greatly aids in the passing of testing requirements to be considered a forced-entry resistant (FER) lock. In an embodiment, the adjustable reinforcement members 21 prevent the access of objects, for example a putty knife, from being inserted between lock keeper 15 and lock housing 14 to engage cam member 17 in an attempt to facilitate unauthorized access to a home or office.

The illustrations and examples provided herein are for explanatory purposes and are not intended to limit the scope of the appended claims.

I claim:

1. A window lock comprising:

a housing configured to be mounted on one of a window frame and a window sash, the housing containing a cam in cooperative engagement with a handle, both the cam and the handle being rotatably affixed to the housing such that rotation of the handle causes corresponding rotation of the cam, the housing including a pair of reinforcement members extending laterally away from a surface of the housing, each of the pair of reinforcement members configured for lateral displacement relative to the surface of the housing such that each reinforcement member is individually adjustable relative to the surface of the housing; and a keeper configured to be mounted on the other of the window frame and the window sash, the keeper defining a central slot and a pair of channels, the central slot configured to receive a portion of the cam therein in a manner to provide latching between the housing and the keeper, and the channels each configured to receive a portion of a corresponding one of the pair of reinforcement members therein in a manner to provide reinforcement of the latching between the housing and the keeper.

2. The window lock of claim 1, wherein the pair of reinforcement members each define a head portion and a body portion.

3. The window lock of claim 2, wherein each of the head portions define a diameter that is greater than a diameter defined by the body portions.

4. The window lock of claim 2, wherein each of the body portions define a plurality of threads.

5. The window lock of claim 2, wherein each of the head portions are attached to the associated body portion at longitudinal end of the associated body portion in opposing relation relative to the housing.

6. The window of claim 2, wherein a distance from the housing to each of the head portions is adjustable.

7. The window lock of claim 1, wherein each of the channels in the keeper define a first portion and a second portion.

8. The window lock of claim 7 further comprising a shoulder within each channel dividing the first portion from the second portion.

9. A window lock comprising:

a housing configured to be mounted on one of a window frame and a window sash, the housing containing a cam in cooperative engagement with a handle, both the cam and the handle being rotatably affixed to the housing such that rotation of the handle causes corresponding rotation of the cam, the housing including a pair of adjustable threaded reinforcement members extending laterally away from a surface of the housing, each of the pair of threaded reinforcement members configured for lateral displacement relative to the surface of the housing such that each reinforcement member is individually adjustable relative to the surface of the housing; and a keeper configured to be mounted on the other of the window frame and the window sash, the keeper defining a central slot and a pair of channels, the central slot configured to receive a portion of the cam therein in a manner to provide latching between the housing and the keeper, and the channels each configured to receive a portion of a corresponding one of the pair of adjustable threaded reinforcement members therein in a manner to provide reinforcement of the latching between the housing and the keeper.

10. The window lock of claim 9, wherein the pair of threaded reinforcement members each define a head portion and a body portion.

11. The window lock of claim 10, wherein each of the head portions define a diameter that is greater than a diameter defined by each of the associated body portions.

12. The window lock of claim 10, wherein each of the head portions are attached to the associated body portion at a longitudinal end of the associated body portion in opposing relation relative to the housing.

13. The window lock of claim 10, wherein a distance from the housing to each of the head portions is adjustable.

14. The window lock of claim 10, wherein each of the channels in the keeper define a first portion and a second portion.

15. The window lock of claim 14 further comprising a shoulder within each channel dividing the respective first portions from the second portions.

* * * * *